US005468133A

United States Patent [19]

Miller et al.

[11] Patent Number: 5,468,133

[45] Date of Patent: Nov. 21, 1995

[54] GAS SHIELD FOR ATOMIZATION WITH REDUCED HEAT FLUX

[75] Inventors: Steven A. Miller, Amsterdam, N.Y.; David P. Mourer, Danvers, Mass.; Milivoj K. Brun, Ballston Lake, N.Y.

[73] Assignee: General Electric Company, Schenectady, N.Y.

[21] Appl. No.: 195,179

[22] Filed: Feb. 14, 1994

Related U.S. Application Data

[63] Continuation of Ser. No. 920,067, Jul. 27, 1992, abandoned.

[51] Int. Cl.[6] ..... B22F 9/08

[52] U.S. Cl. ..... 425/7; 75/338; 264/12

[58] Field of Search ..... 425/6, 7; 264/11, 264/12, DIG. 75; 75/335, 338, 339, 355; 65/5, 16

[56] References Cited

U.S. PATENT DOCUMENTS

| | | | |
|---|---|---|---|
| 1,859,992 | 5/1932 | Seil | 75/338 |
| 3,387,783 | 6/1968 | Schellenberg et al. | 65/5 |
| 3,817,503 | 6/1974 | Lafferty et al. | 425/7 |
| 3,988,084 | 10/1976 | Esposito et al. | 425/7 |
| 4,575,325 | 3/1986 | Duerig et al. | 425/7 |
| 4,578,022 | 3/1986 | Kenney | 425/7 |
| 4,619,597 | 10/1986 | Miller | 425/7 |
| 4,619,845 | 10/1986 | Ayers et al. | 427/422 |
| 4,631,013 | 12/1986 | Miller | 425/7 |
| 4,778,516 | 10/1988 | Raman | 425/7 |
| 4,801,412 | 1/1989 | Miller | 425/7 |

OTHER PUBLICATIONS

"Atomization of Specialty Alloy Powders," Alan Lawley, Journal of Metals, 1981, pp. 13–18.

*Primary Examiner*—Jay H. Woo
*Assistant Examiner*—Joseph Leyson
*Attorney, Agent, or Firm*—R. Thomas Payne; James Magee, Jr.

[57] ABSTRACT

Apparatus for close coupled atomization of melts of metals having high melting points with low superheats is taught. The atomization apparatus includes means for supplying melt to be atomized at the relatively low superheat, melt guide means for guiding the melt as a stream to an atomization zone and a gas supply and means for delivering the gas as a stream to the atomization zone where both the melt supply and gas supply to the atomization zone are in very close proximity. The melt supply has an inwardly tapered lower end disposed immediately above the atomization zone. The gas supply surrounds the melt guide tube and the gas is delivered as a jet against the melt emerging from the melt guide tube. The temperature of the gas impacting the end of the melt guide tube is very low because of the gas expansion. The tendency for this gas to withdraw heat from the melt guide tube and cause a freeze-up is reduced by providing a shield for guiding the gas from the gas supply to the orifice where most of the gas expansion and cooling takes place. The gas shield contacts the melt supply tube at its lower end and conducts heat from the melt supply tube toward its upper end. The gas shield is kept very thin, and at least one groove is formed laterally in the gas shield to inhibit and reduce the flow of heat from the lower portion to the upper portion of the gas shield.

5 Claims, 5 Drawing Sheets

GAS SHIELD FOR ATOMIZATION WITH REDUCED HEAT FLUX

This application is a continuation of application Ser. No. 07/920,067, filed Jul. 27, 1992, now abandoned.

CROSS-REFERENCE TO RELATED APPLICATIONS

The present invention relates closely to commonly owned applications:

Ser. No. 07/920,075, filed on Jul. 27, 1992, now abandoned; Ser. No. 07/920,066, filed on Jul. 27, 1992, now abandoned; Ser. No. 07/928,581, filed on Aug. 13, 1992, now abandoned; Ser. No. 07/920,078, filed on Jul. 27, 1992, now abandoned; Ser. No. 07/928,596, filed on Aug. 13, 1992, now abandoned; Ser. No. 07/898,609, filed on Jun. 15, 1992, now U.S. Pat. No. 5,280,884; Ser. No. 07/928,595, filed on Aug. 13, 1992, now abandoned; Ser. No. 07/961,942, filed on Oct. 16, 1992, now abandoned; Ser. No. 07/898,602, filed on Jun. 15, 1992, now U.S. Pat. No. 5,366,204; and Ser. No. 07/928,385, filed on Aug. 12, 1992, now abandoned. The texts of the related applications are incorporated herein by reference.

BACKGROUND OF THE INVENTION

The present invention relates generally to closely coupled gas atomization. More particularly, it relates to methods and means by which closely coupled gas atomization processing of high melting reactive molten metal can be started and carried out with significantly reduced melt superheat.

The technology of close coupled or closely coupled atomization is a relatively new technology. Methods and apparatus for the practice of close coupled atomization are set forth in commonly owned U.S. Pat. Nos. 4,631,013; 4,801,412; and 4,619,597, the texts of which are incorporated herein by reference. As pointed out in these patents, the idea of close coupling is to create a close spatial relationship between a point at which a melt stream emerges from a melt orifice into an atomization zone and a point at which a gas stream emerges from a gas orifice to impact the melt stream as it emerges from the melt orifice into the atomization zone. Close coupled atomization is accordingly distinguished from the more familiar and conventional remotely coupled atomization by the larger spatial separation between the respective nozzles and point of impact in the remotely coupled apparatus. A number of independently owned prior art patents deal with close proximity of melt and gas streams and include U.S. Pat. Nos. 3,817,503; 4,619,845; 3,988,084; and 4,575,325.

In the more conventional remotely coupled atomization, a stream of melt may be in free fall through several inches before it is impacted by a gas stream directed at the melt from an orifice which is also spaced several inches away from the point of impact.

The remotely coupled apparatus is also characterized by a larger spatial separation of a melt or if ice from a gas orifice of the atomization apparatus. Most of the prior art of the atomization technology concerns remotely coupled apparatus and practices. One reason for this is that attempts to operate closely coupled atomization apparatus resulted in many failures due to the many problems which are encountered. This is particularly true for efforts to atomize reactive metals which melt at relatively high temperatures of over 1000° C. or more. The technology disclosed by the above referenced commonly owned patents is, in fact, one of the first successful closely coupled atomization practices that has been developed.

The problem of closely coupled atomization of highly reactive high temperature (above 1,000° C.) metals is entirely different from the problems of closely coupled atomization of low melting metals such as lead, zinc, or aluminum. The difference is mainly in the degree of reactivity of high reacting alloys with the materials of the atomization apparatus.

One of the features of the closely coupled atomization technology, particularly as applied to high melting alloys such as iron, cobalt, and nickel base superalloys is that such alloys benefit from having a number of the additive elements in solid solution in the alloy rather than precipitated out in the alloy and the closely coupled atomization can result in a larger fraction of additive elements remaining in solid solution. For example, if a strengthening component such as titanium, tantalum, aluminum, or niobium imparts desirable sets of properties to an alloy, this result is achieved largely from the portion of the strengthening additive which remains in solution in the alloy in the solid state. In other words, it is desirable to have certain additive elements such as strengthening elements remain in solid solution in the alloy rather than in precipitated form. Closely coupled atomization is more effective than remotely coupled atomization in producing the small powder sizes which will retain the additive elements in solid solution.

Where still higher concentrations of additive elements are employed above the solubility limits of the additives, the closely coupled atomization technology can result in nucleation of precipitates incorporating such additives. However, because of the limited time for growth of such nucleated precipitates, the precipitate remains small in size and finely dispersed. It is well-known in the metallurgical arts that finely dispersed precipitates are advantageous in that they impart advantageous property improvements to their host alloy when compared, for example, to coarse precipitates which are formed during slow cooling of large particles. Thus, the atomization of such a superalloy can cause a higher concentration of additive elements, such as strengthening elements, to remain in solution, or precipitate as very fine precipitate particles, because of the very rapid solidification of the melt in the closely coupled atomization process. This is particularly true for the finer particles of the powder formed from the atomization.

In this regard, it is known that the rate of cooling of a molten particle of relatively small size in a convective environment such as a flowing fluid or body of fluid material is determined by the properties of the droplet and of the cooling fluid. For a given atomization environment, that is one in which the gas, alloy, and operating conditions are fixed, the complex function relating all the properties can be reduced to the simple proportionality involving particle size shown below, $$T_p \alpha \frac{1}{D_p^2}$$

where:

$T_p$=cooling rate, and $D_p$=droplet diameter.

Simply put, the cooling rate for a hot droplet in a fixed atomization environment is inversely proportional to the diameter squared. Accordingly, the most important way to increase the cooling rate of liquid droplets is to decrease the size of the droplets. This is the function of effective gas atomization.

Thus it follows that if the average size of the diameter of a droplet of a composition is reduced in half, then the rate of cooling is increased by a factor of about 4. If the average diameter is reduced in half again, the overall cooling rate is increased 16 fold.

Since high cooling rates are predominantly produced by reducing droplet size, it is critical to effectively atomize the melt.

The Weber number, We, is the term assigned to the relationship governing droplet breakup in a high velocity gas stream. The Weber number may be calculated from the following expression:

$$We = \frac{\rho V^2 D}{\sigma}$$

where $\rho$ and V are the gas density and velocity, and $\sigma$ and D are the droplet surface tension and diameter.

When the We number exceeds ten, the melt is unstable and will breakup into smaller droplets. The dominant term in this expression is gas velocity and thus in any atomization process it is essential to have high gas velocities. As described in the commonly owned U.S. Pat. No. 4,631,013 the benefit of close coupling is that it maximizes the available gas velocity in the region where the melt stream is atomized. In other words, the close coupling is itself beneficial to effective atomization because there is essentially no loss of gas velocity before the gas stream from the nozzle impacts the melt stream and starts to atomize it.

Because of this relationship of the particle size to the cooling rate, the best chance of keeping a higher concentration of additive elements of an alloy, such as the strengthening additives, in solid solution in the alloy is to atomize the alloy to very small particles. Also, the microstructure of such finer particles is different from that of larger particles and often preferable to that of larger particles.

For an atomization processing apparatus, accordingly the higher the percentage of the finer particles which are produced the better the properties of the articles formed from such powder by conventional powder metallurgical techniques. For these reasons, there is strong economic incentive to produce finer particles through atomization processing.

As pointed out in the commonly owned prior art patents above, the closely coupled atomization technique results in the production of powders from metals having high melting points with higher concentration of fine powder. For example, it was pointed out therein that by the remotely coupled technology only 3% of powder produced industrially is smaller than 10 microns and the cost of such powder is accordingly very high. Fine powders of less than 37 microns in diameter of certain metals are used in low pressure plasma spray applications. In preparing such powders by remotely coupled techniques, as much as 60–75% of the powder must be scrapped because it is oversized. This need to selectively separate out only the finer powder and to scrap the oversized powder increases the cost of useable powder.

Further, the production of fine powder is influenced by the surface tension of the melt from which the fine powder is produced. For melts of high surface tension, production of fine powder is more difficult and consumes more gas and energy. The remotely coupled industrial processes for atomizing such powder have yields of less than 37 microns average diameter from molten metals having high surface tensions of the order of 25 weight % to 40 weight %. A major cost component of fine powders prepared by atomization and useful in industrial applications is the cost of the gas used in the atomization. Using remotely coupled technology, the cost of the gas increases as the percentage of fine powder sought from an atomized processing is increased. Also, as finer and finer powders are sought, the quantity of gas per unit of mass of powder produced by conventional remotely coupled processing increases. The gas consumed in producing powder, particularly the inert gas such as argon, is expensive.

As is explained more fully in the commonly owned patents referred to above, the use of the closely coupled atomization technology of those patents results in the formation of higher concentrations of finer particles than are available through the use of remotely coupled atomization techniques. The texts of the commonly owned patents are incorporated herein by reference.

As is pointed out more fully in the commonly owned U.S. Pat. No. 4,631,013, a number of different methods have been employed in attempts to produce fine powder. These methods have included rotating electrode process, vacuum atomization, rapid solidification rate process and other methods. The various methods of atomizing liquid melts and the effectiveness of the methods is discussed in a review article by A. Lawly, entitled "*Atomization of Specialty Alloy Powders*", which article appeared in the Jan. 19, 1981 issue of the Journal of Metals. It was made evident from this article and has been evident from other sources that gas atomization of molten metals produces the finest powder on an industrial scale and at the lowest cost.

It is further pointed out in the commonly owned U.S. Pat. No. 4,631,013 that the close coupled processing as described in the commonly owned patents produces finer powder by gas atomization than prior art remotely coupled processing.

A critical factor in the close coupled gas atomization processing of molten metals is the melting temperature of the molten metal to be processed. Metals which can be melted at temperatures of less than 1000° C. are easier to atomize than metals which melt at 1500° or 2000° C. or higher, largely because of the degree of reactivity of the metal with the atomizing apparatus at the higher temperatures. The nature of the problems associated with close coupled atomization is described in a book entitled "*The Production of Metal Powders by Atomization*", authored by John Keith Beddow, and printed by Haden Publishers, as is discussed more fully in the the commonly owned U.S. Pat. No. 4,631,013.

The problems of attack of liquid metals on the atomizing apparatus is particularly acute when the more reactive liquid metals or more reactive constituent of higher melting alloys are involved. The more reactive metals include titanium, niobium, aluminum, tantalum, and others. Where such ingredients are present in high melting alloys such as the superalloys, the tendency of these metals to attack the atomizing apparatus itself is substantial. For this reason, it is desirable to atomize a melt at as low a temperature as is feasible.

It has been observed with regard to the prior art structures as discussed above relative to the prior art patents that where the superheat in the melt passing through the melt guide tube is at a sufficiently low level, there is a tendency for the molten metal passing through the melt guide tube to form a solid layer of solidified metal against the inner wall of the melt guide tube and eventually to solidify completely, thus blocking melt guide tube and in effect terminating the atomization procedure.

In one of its broader aspects, objects of the present invention can be achieved by providing close coupled gas atomization apparatus for atomization of metals having melting temperature above 1000° C. The apparatus includes means for supplying melt to be atomized at a relatively low superheat of less than 50° C., and melt guide tube means for guiding the melt as a stream from the supply means and for introducing the stream into an atomization zone. The melt guide tube means has a lower end which is inwardly tapered to a melt orifice immediately above the atomization zone. The atomization apparatus also includes closely coupled gas supply means disposed at least partially about the melt guide tube orifice for supplying atomizing gas and for directing the atomizing gas into the atomization zone to atomize the melt flowing from the melt guide tube. The gas supply means includes at least one gas inlet, a gas manifold to distribute gas around the melt guide tube, at least one gas orifice poised above and aimed at the atomization zone and at least one gas shield to guide gas from the manifold to at least one of the orifices. The gas shield has at least one surface disposed at least partially vertically to guide gas from the manifold inward toward the melt guide tube and downward toward the atomization zone. The gas shield is closely coupled in that it is poised proximate the lower end of the melt guide tube to receive heat from the melt guide tube. The at least partially vertical portion of the gas shield has at least one lateral groove therein to impede the conductive movement of heat from the lower portion of the gas shield to the upper portion thereof.

BRIEF DESCRIPTION OF THE DRAWINGS

The description of the present invention which follows will be understood with greater clarity if reference is made to the accompanying drawings in which.

BRIEF STATEMENT OF THE INVENTION

Figure 1:
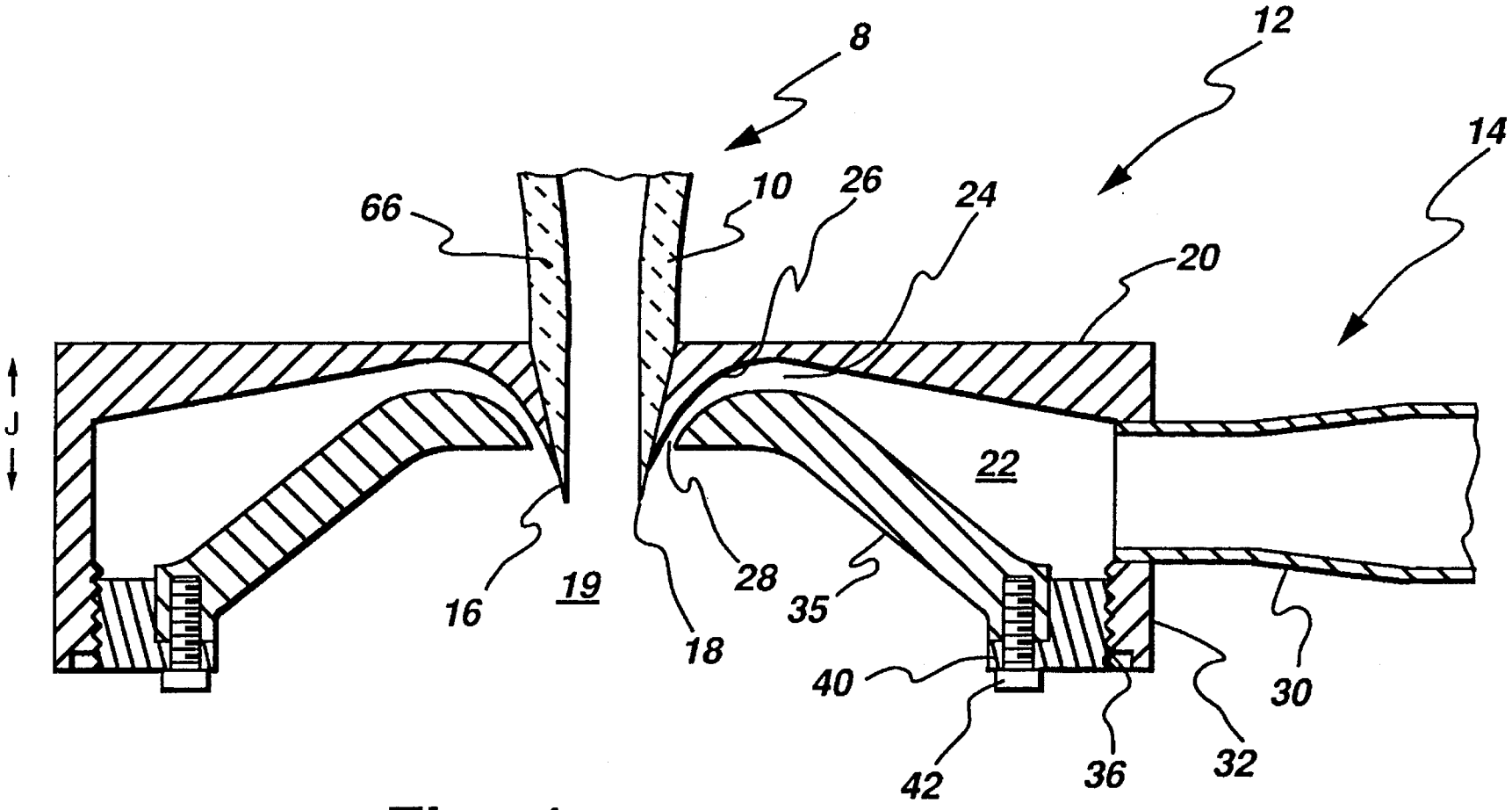
FIG. 1 is a semischematic sectional view of the lower end of a ceramic melt guide tube and of the adjoining gas shield and other portions of a gas atomization nozzle.

As has been evident from a number of journal articles and other sources, the powder metallurgy industry has been actively driving toward greatly increased usage of fine powders over the past two decades. One of the reasons is the recognition that superior metallurgical properties are achieved because of the higher solubility of strengthening and similar additives in alloys which are converted into the very fine powder as discussed above. Generally, greater strength, toughness, and fatigue resistance can be attained in articles prepared via the fine powder route for such alloys as compared to the properties found in the same alloys prepared by ingot or other conventional alloy technology. These improvements in properties come about principally due to the extensions of elemental solubility in the solid state which are obtainable via fine powder processing. In other words, the additives preferably remain in solid solution or in tiny nucleated precipitate particles in the host alloy metal and impart the improved properties while in this state as also discussed above. Generally, the finer the powder, the more rapidly it is solidified and the more the solubility limits are extended. In addition, the limits on the alloying additions processed through the fine powder route are increased.

A nemesis of the improved property achieved through fine powder processing however is contamination by foreign materials which enter the powder prior to consolidation. The contamination acts to reduce the local strength, fatigue resistance, toughness, and other properties and thus the contamination becomes a preferred crack nucleation site. Once nucleated, the crack can continue to grow through what is otherwise sound alloy and ultimately results in failure of the entire part.

What is sought pursuant to the present invention is to provide a process capable of manufacture of powder that is both finer and cleaner, and to do so on an industrial scale and in an economical manner.

In order to accomplish this result, one of the problems which must be overcome is to reduce the major source of defects introduced by the prior art conventional powder production process itself. In the conventional powder production process, the alloy to be atomized is first melted in ceramic crucibles and then is poured into a ceramic tundish often by means of a ceramic launder and is finally passed through a gas atomization nozzle employing ceramic components. In the case in which the alloy to be atomized is a superalloy, it is well-known to contain highly reactive components such as titanium, zirconium, molybdenum, and aluminum, among others, and that these metals are highly reactive and have a strong tendency to attack the surfaces of ceramic apparatus which they contact. A typical liquidus temperature of a nickel base superalloy is about 1350° C., for example. The attack can result in formation of ceramic particles and these particles are incorporated into the melt passing through the atomization process and ultimately in the final powder produced by the atomization process. These ceramic particles are a major source of the foreign matter contamination discussed above.

One way in which the conventional extensive use of ceramic containment and ceramic surfaces can be eliminated is through the use of the so-called cold hearth melting and processing apparatus. In this known cold hearth apparatus, a copper hearth is cooled by cold water flowing through cooling channels embedded in the copper hearth. Because the hearth itself is cold, a skull of the metal being processed in the hearth is formed on the inner surface of the hearth. The liquid metal in the hearth thus contacts only a skull of the same solidified metal and contamination of the molten metal by attack of ceramic surfaces is avoided. However, it has now been found that the use of cold hearth processing results in a supply of molten metal which has a very low superheat in comparison to the superheat of metal processed through the prior art ceramic containment devices. The superheat is defined here as a measure of the difference between the actual temperature of the molten alloy melt being processed and the melting point or more specifically the liquidus temperature of that alloy. For apparatus employed in close coupled atomization as described in the commonly owned patents referred to above, higher superheats in the range of 200°–250° C. are employed to prevent the melt from freezing off in the atomization nozzle. For apparatus which is more loosely coupled than that described in these patents, a 100°–250° C. or higher superheat is employed to prevent a melt from excessive loss of heat and freezing during processing.

An important point regarding the processing of melts with low superheats of 50° C. or less is that strengthening and other additives are as fully dissolved in a melt having a low superheat as they are in a melt having a high superheat. Accordingly, improvements in properties of fine powders, of less than 37 micron diameter for example, is found in essentially equal measure in fine powders prepared from melts with low superheats as in fine powders prepared from melts having high superheats.

In using a cold hearth containment to provide a reservoir of molten metal for atomization, it has been found that application of heat to the upper surface of the melt is economic and convenient. Such heat may be applied, for example, by plasma arc mechanisms, by electron beam or by other means. Because a melt contained in a cold hearth loses heat rapidly to the cold hearth itself, it has not been possible to generate significant superheat in the melt. Measured superheats of melts contained in cold hearth indicates that time averaged superheats of up to about 50° C. in magnitude are feasible. Because the melts supplied from cold hearth sources have relatively low superheat of the order of 10°–50° C., there is a much higher tendency for such melts to freeze up in the nozzle of an atomization apparatus. For this reason, attempts to atomize melts having low superheats of less than 50° C. at standard flow rates through the closely-coupled atomization apparatus of the commonly owned patents have failed due to freeze-up of the melt in the atomization nozzle. Herein lies a critical distinction between the processing of melt prepared for atomization in the older ceramic systems as compared to the new cold hearth approach described herein. In practical terms, in the old ceramic system any desired amount of superheat could be attained. Thus, heat extraction by the gas plenum was never addressed in the plenum design. It was possible to simply increase the superheat of the melt to compensate for any heat extraction by the gas plenum. However, in the new cold hearth systems, we have found it impossible to date to produce a superheat of more than 50°–70° C. and we have found this superheat to be insufficient to prevent freeze-off in close coupled atomization using the prior art nozzles of the commonly owned patents referred to above. We have now devised a new gas plenum design that permits atomization with only 50°–70° C. or less superheat. Close coupled atomization of a melt with such low superheat was previously deemed impossible. One important aspect of this invention was to reduce heat flow from the melt to the cold gas plenum. In part, this was accomplished by reducing the vertical dimension of the plenum in the region where the melt must pass thru the plenum.

The U.S. Pat. Nos. 4,578,022; 4,631,013; and 4,778,516; provide discussions of concern with this problem. The text of these patents address and solve many of the issues in the atomization of high temperature melts and the production of fine powder. Noticeably missing, however, is discussion of the issue of freeze-off of the melt stream due to the lack of superheat and the discussion of system limitations that prevent increasing the melt superheat. This is because prior work was done with ceramic melting systems, where for conventional alloys there are no practical limits to how much superheat can be provided. Only with the recent advent of cold hearth melting has it become necessary to solve the problem of increased freeze off due to low superheat. Thus, while the devices disclosed in these and other prior art patents have geometries that are superficially similar to those disclosed herein, they do not make atomization of melts with low superheats of the order of 10°–50° C. feasible.

Figure 3:
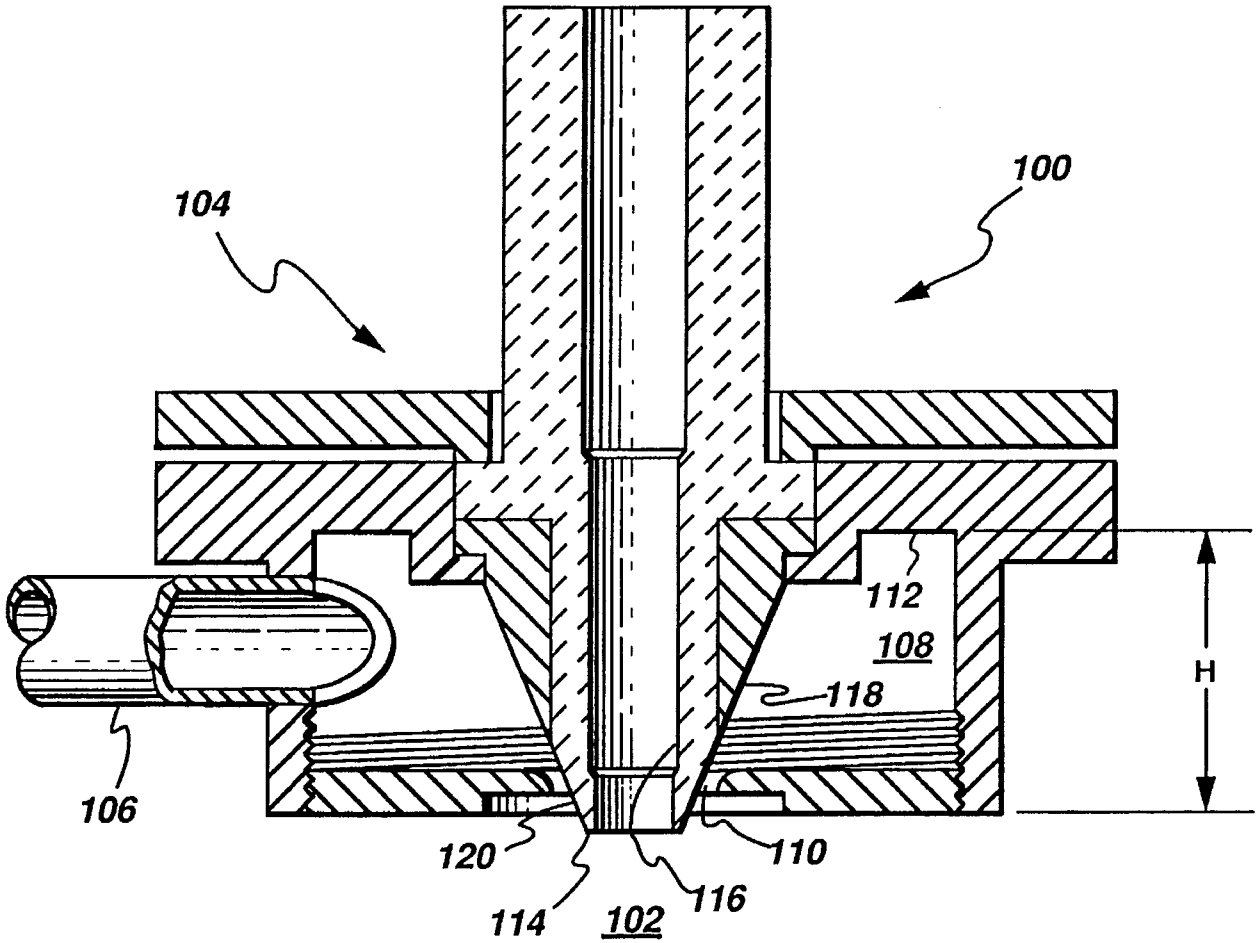
Fig. 3 (PRIOR ART)
FIG. 3 is a vertical sectional view of a prior art close coupled atomization apparatus.

FIG. 3 is a vertical section of a prior art close coupled atomization as disclosed in commonly owned U.S. Pat. No. 4,631,013 and others referred to above. The mechanism is made up essentially of two parts, the first of which 100 is a melt guide tube for guiding a melt to an atomization zone 102 directly below the lower-most portion of melt guide tube 100. The second portion is gas supply and nozzle arrangement 104 which supplies atomizing gas to the atomization zone 102 through a gas inlet 106, a gas plenum 108, and an annular gas orifice 110. Of particular interest in this mechanism is the vertical distance, H, in which there is a parallel flow of the metal to be atomized and of the atomizing gas. This height, H, shown by the arrow on the right-hand side of the figure illustrates the vertical component of the gas flow from the top 112 of plenum 108 to the bottom 114 of the melt guide tube 100 against which the gas flows both within the plenum 108 and as it exists the plenum through orifice 110.

The height, H, also illustrates the height of the column of liquid metal within the bore 116 of melt guide tube 100 which is in parallel flow with the vertical component of gas flow through the plenum 108 and orifice 110. The gas from pipe 106 expands into plenum 108 and expands further as it leaves orifice 110. In both expansions the gas is spontaneously cooled and spontaneously removes heat from the gas shield 118 and from the inwardly tapered surface 120 of the lower end of melt guide tube 100.

One aspect of improving the start-up of close coupled atomization is a reduction in the height, H, over which there is a parallel flow of atomizing gas and melt to be atomized.

The prior art apparatus of FIG. 3 contrasts with the novel apparatus of this invention as now described with reference to FIGS. 1, 2, and 4.

The invention and the features thereof are now described with reference to FIGS. 1 and 2.

Figure 2:
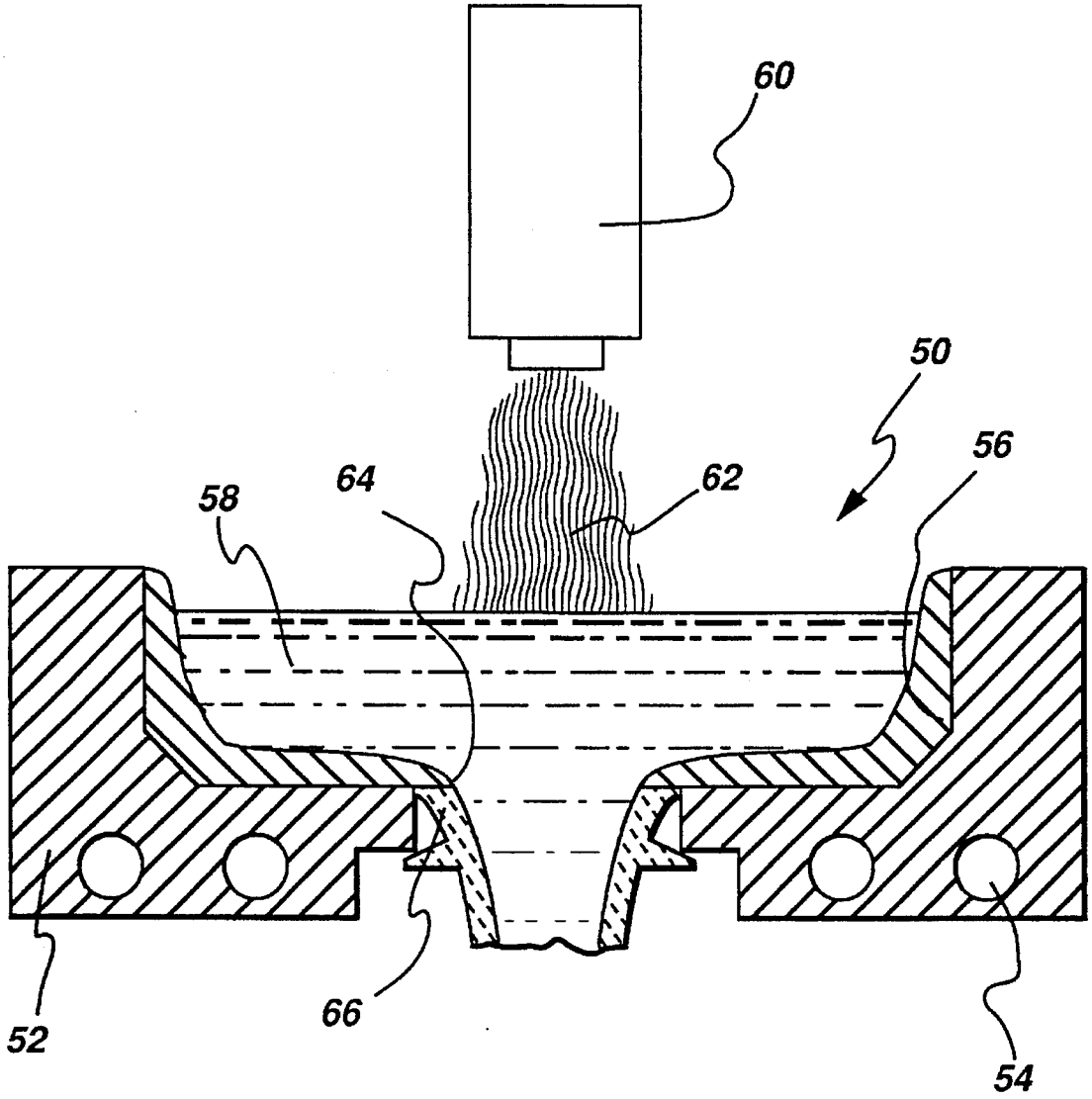
FIG. 2 is a semischematic vertical sectional view of a melt supply apparatus and the upper part of a melt guide tube.

In this regard, reference is made next to FIG. 2. In FIG. 2 a melt supply reservoir and the upper portion of a melt guide tube are shown semischematically. The figure is semischematic in part in that the hearth 50 and tube 66 are not in size proportion in order to gain clarity of illustration. The melt supply is from a cold hearth apparatus 50 which is illustrated undersize relative to tube 66. This apparatus includes a copper hearth or container 52 having water cooling passages 54 formed therein. The water cooling of the copper container 52 causes the formation of a skull 56 of frozen metal on the surface of the container 52 thus protecting the copper container 52 from the action of the liquid metal 58 in contact with the skull 56. A heat source 60, which may be for example a plasma gun heat source having a plasma flame 62 directed against the upper surface of the liquid metal of molten bath 58, is disposed above the surface of the reservoir 50. The liquid metal 58 emerges from the cold hearth apparatus through a bottom opening 64 formed in the bottom portion of the copper container 52 of the cold hearth apparatus 50. Immediately beneath the opening 64 from the cold hearth, the top of a melt guide tube 66 is disposed to receive melt descending from the reservoir of metal 58. The top portion of tube 66 is illustrated oversize relative to hearth 50 for clarity of illustration.

The melt guide tube 66 is positioned immediately beneath the copper container 52 and is maintained in contact therewith by conventional means not shown to prevent spillage of molten metal emerging from the reservoir of molten metal 58 within the cold hearth apparatus 50. The melt guide tube 66 is a ceramic structure which is resistant to attack by the molten metal 58. Tube 66 may be formed of boron nitride, aluminum oxide, zirconium oxide, beryllium oxide, hafnium oxide, or other suitable ceramic material. The molten metal flows down through the melt guide tube to the lower portion thereof from which it can emerge as a stream into an atomization zone.

What has been discovered relative to the close coupled atomization is that while the teachings of the commonly owned prior art patents referenced above represented a substantial advance in the art, there are certain problems which remain relative to the use of this type of structure in close coupled atomization practices. One of the problems associated with the use of prior art atomization apparatus is that the apparatus required the use of relatively high superheat in the metal. Relatively high superheat melt was used to avoid the problem of freezing in the melt delivery tube if the superheat of the metal passing through the melt delivery tube was not sufficiently high. A superheat of 250°–300° C. in a melt atomized according to the prior art practice was found to be satisfactory and avoided the formation of blocking freeze-up in the melt guide tube. However, where the superheat in the metal to be atomized was only of the order of 10°–50° C. there was a much greater tendency for a solid blockage to form within the melt guide tube.

What the applicants have sought to do through the practice of the present invention is to limit the amount of superheat within molten metal being processed through a closely coupled atomization process and at the same time keep the process operating and avoiding the shutdown due to freezing within the melt guide tube. We have found that one way in which this can be accomplished is by limiting the flow of heat from the high temperature melt within the melt guide tube to the low temperature gas used to atomize the molten metal. A way in which this may be accomplished is now described with reference to the accompanying figures.

Referring now first to FIG. 1, a gas atomization apparatus having a shallow profile is illustrated. The apparatus consists essentially of three sections. The first section is a melt guide section 8; the second is a gas distribution section 12; and the third is a gas supply section 14. The melt supply section has a melt guide tube 10 which is a continuation of the melt guide tube 66 of FIG. 2. The melt guide tube 10 has a lower section 16 which has an inward taper on the external surface thereof. The melt guide tube 10 terminates in a lower tip shown in section in FIG. 1 which essentially comes to a point at an orifice 18 immediately above an atomization zone 19.

The gas supply portion 14 of the device is basically a gas inlet tube which is connected at its other end, not shown, to a supply of an atomizing gas such as argon.

The gas distribution structure 12 has a housing 20 which has a low profile and which contains a plenum 22 through which gas is distributed around the base of the melt guide tube 10. The housing 20 includes also an adjustable plate element 35 which can be raised or lowered through the turning thereof and through the action of the set of matching threads 36, one set of which is on the housing 20 and the other set of which is on the ring structure 40. The ring structure is mounted to the plate 35 by screw means 42.

The plate 35 is juxtaposed from the inner surface of housing 20 to form a neck 24 through which gas is passed into contact with a gas shield 26 and then through an orifice 28 into contact with melt passing through melt guide tube 10 and emerging therefrom at orifice 18.

This is the basic structure of the atomization nozzle. However, specific details are now described with reference to FIGS. 4 and 5.

Figure 4:
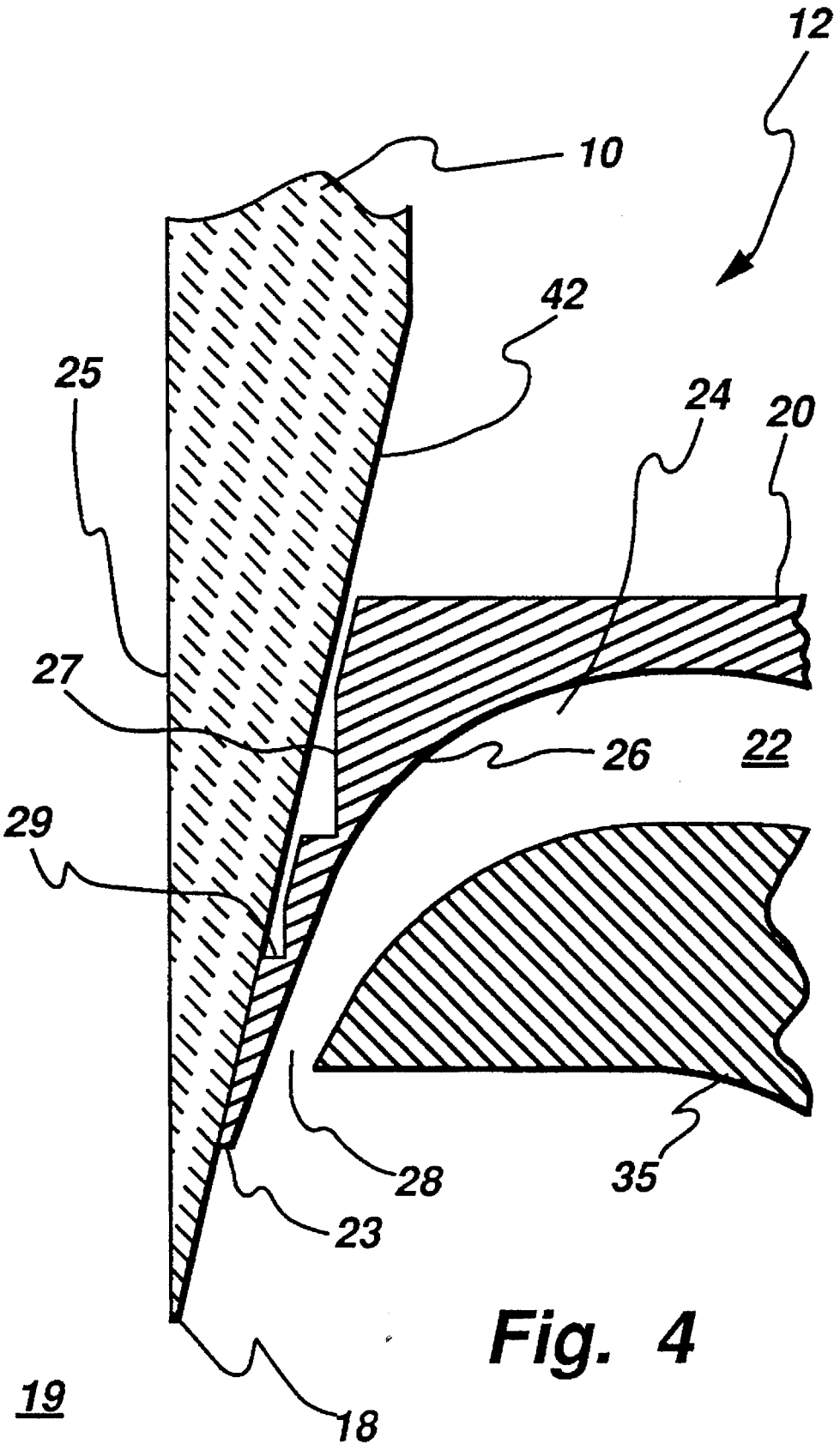
FIGS. 4 and 5 are detailed views of a structure similar to that of FIG. 1 but illustrating a different form of melt guide tube and gas shield.

Referring now next to FIG. 4, fragments of the right-hand portion of a melt guide tube 10 and fragments of gas nozzle 12 are illustrated. There are some differences in detail between the general low profile close coupled structure of FIG. 1 and the detailed structure of FIG. 4 and 5. The detailed structures illustrate more clearly the details which are relevant to describing the present invention. Tube 10 has a tubular configuration. At its lower portion, the outer surface of tube 10 has an inwardly tapered or beveled surface 42. The taper extends to the melt guide tube lowermost portion 16 of the tube where the molten metal flowing through the tube exits the melt delivery tube and enters the atomization zone 19 immediately therebelow. The melt guide tube 10 is a ceramic material and may be, for example, boron nitride, or zirconium oxide, aluminum oxide, or other ceramic having an inert chemical character at high temperatures.

An annular gas supply 12 surrounds the lower end of the melt guide tube 10. The annulus is metal and includes an inlet for supply of gas to the annulus (not shown) as well as an annular plenum chamber 22 by which the gas is distributed around the annulus. An annular gas orifice 28 is positioned to direct gas down against the lower tip 18 of the melt guide tube and into contact with the molten metal flowing from the melt guide tube into an atomization zone 19 immediately therebelow. Above, and to the left, of the nozzle 28 is a gas shield 26.

One purpose of the gas shield is to isolate a large portion of the melt guide tube body from the cold atomization gas. The gas shield extends from the top of the annular housing structure 20 to a tip 23, a tip which is positioned against the lower portion of the inwardly tapered external surface 42 of the melt guide tube 10. It is apparent that because the lower end of the melt guide tube is tapered inwardly there is a smaller thickness of melt guide tube wall as the tube itself tapers toward the bottom end point 18. Because of this taper, the high temperature melt within the melt guide tube which passes against and into contact with the inner surface 25 yields up more and more of its heat as the melt descends. This increased heat transfer occurs in part because there is a smaller thickness of melt guide tube through which it must pass to reach the external tapered surface 42 of the melt guide tube. At the location where the point 23 of the gas shield 26 contacts the thin wall lower section of the melt guide tube, the heat transfer through the melt guide tube is quite rapid because of the thinness of the melt guide tube at this point. Consequently, there is a high degree of heat transfer through the thin lower portion of the melt guide tube to the lower portion 23 of the gas shield 26. A substantial portion of the heat arriving at the lower end of the gas shield can be conducted up and away through the metal of the gas shield to the bulk of the annular structure 12

Pursuant to the present invention, the conductive transfer of heat from the lower portion 23 of the heat shield to the body 20 of the gas annulus is limited and restricted by the formation of at least one annular notch 27 in the stem of the gas shield 26. In the figure, there are two such notches, 27 and 29, which are illustrated. Because these notches are annular in shape and extend all the way around the annular gas shield 26, they are able to restrict the conductive flow of heat up from point 23 toward the thicker portions of the gas shield and of the housing 20.

While the description given here with respect to inhibiting conductive flow of heat from the lowermost section 23 of the gas shield 26 and specifically the section immediately above the tip 23 of the gas shield is described with reference to grooves such as groove 27 or 29 and while the use of such grooves does effectively restrict and limit the conductive heat flow up through the gas shield 26 to the more massive body 26 of the gas shield metal it will be appreciated that other configurations of grooves or notches which have the effect of thinning the wall of the gas shield above the section proximate tip 23, where the highest level of heat from the melt within the melt guide tube is received, can also be employed. For example, a trough which effectively thins the cross section of the metal above the gas shield in the area which adjoins the tapered surface 42 of the melt guide tube can effectively limit the conductive flow of heat up through the gas shield 26 toward the more massive body of metal of the gas supply 20. It is, of course, readily recognized that conductive flow of heat through a metal body is a route through which heat can move rapidly from a zone at a higher temperature to a zone at a lower temperature. However, we have recognized that because of the high strength of the metals, including refractory metals, which can be employed in formation of the gas supply mechanism 12 it is possible to preserve the smooth inner surface of the gas shield 26 which is presented to the gas moving therealong and thereagainst and to nevertheless restrict and limit the flow of heat up through the gas shield to the body of the mechanism 20 which serves as a heat sink. This is accomplished principally by grooving or otherwise thinning the outside wall of the gas shield in a location intermediate between the tip 23 and the bulky upper portion of the gas shield 26 Accordingly, the pattern of gas flow against the gas shield is preserved as the inner surface of the gas shield is not disturbed but the conductive flow of heat up through the gas shield is reduced and minimized.

It will further be recognized that where our method of restricting conductive heat flow is employed, the loss of heat from the melt within the melt guide tube lower most portion 10 to the gas shield is reduced and limited and where the superheat of the melt is from 5° to 50° C. such reduction is very significant in avoiding the freeze-up of the melt with the melt guide tube and the termination of the atomization process.

Figure 5:
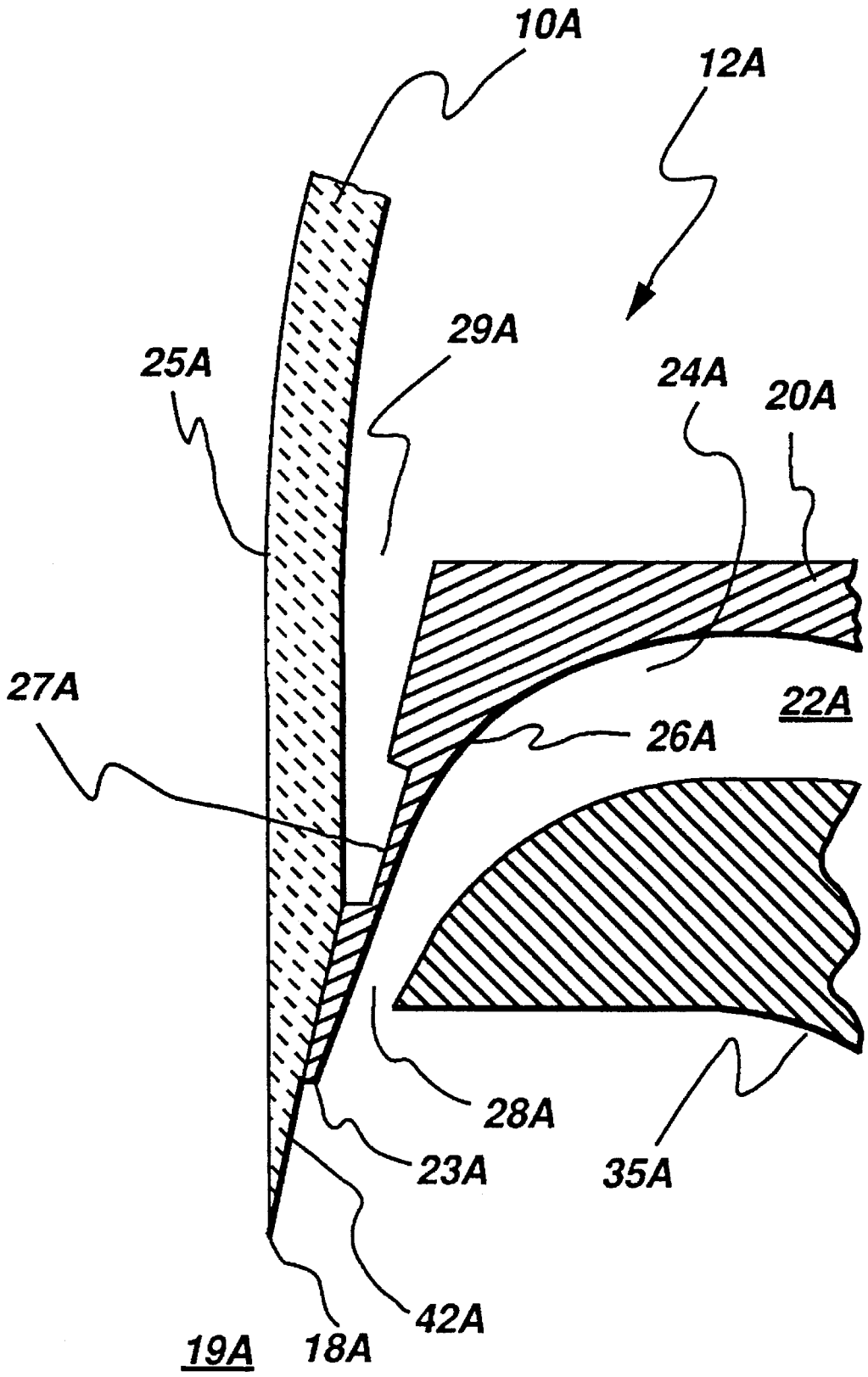

In FIG. 5, a vertical section of fragmentary portions of the right half of the lower end of a melt guide tube 10A and of the gas supply 12A are illustrated in detail. In this illustration the configuration of the melt guide tube itself is altered to a thinner cross-section. This configuration increases the gap between the melt guide tube 10A and the body of the gas supply mechanism 12A. The thinner walled melt guide tube 10A is, of course, subject to transmission of higher flux of heat through the melt guide tube wall. In this connection, a larger gap 29A is established between the outer wall of the melt guide tube and the outer wall of the gas supply. However, as is also evident, the lower tip 23A of the gas shield is in contact with a tapered outer surface 42A of the melt guide tube and the wall of the gas shield is thinned by the inclusion of a trough 27A in the outer wall surface of the gas shield 26A. This trough is effective in reducing the conductive heat flow up from the lowermost portion of the gas shield 23A to the upper more bulky part of the gas supply mechanism 12A.

The other portions of the apparatus of FIG. 5 bear reference numerals which correspond to like portions of the structure illustrated in FIG. 4 with the exception that the reference numerals of FIG. 5 include the letter A. Like portions of the structure of FIG. 5 have like functions to the corresponding portions of FIG. 4.

By extending the grooves both in number and in width, the optimum form of gas shield is produced. Such a shield is essentially a very thin foil-like structure. It will be appreciated that the limit on the thinness of the shield is the requirement that it contain the high pressure atomizing gas. The structures illustrated in FIGS. 4 and 5 are stronger and easier to fabricate than the optimum foil-like structure.

Also, as shown in FIGS. 4 and 5, the inner and outer surface of the gas shield are machined at two different angles. We have found an angular difference of about 8° is preferred when tip 23 is limited to about 0.005 inches in thickness. This 8° angle provides adequate structural strength while limiting the thickness of the gas shield to approximately 0.055" at the thickest point. We have also tested structures at angular difference up to 11° but this larger angle provides unnecessary thickness to the gas shield. Angular differences beneath 7° proved very difficult to machine because the thin wall of the gas shield deflects under loading from the cutting tool.

Rather than the whole shield being thin, it is possible, as shown in 4 and 5, to machine notches in the wall. Machined to approximately one half the wall thickness, they impede heat flow up the gas shield without degrading the strength of the shield.

What is claimed is:

1. A close coupled gas atomization apparatus for atomization of metals having melting temperatures above 1000° C. wherein the apparatus comprises a melt guide means, including a melt guide tube having an orifice, a gas distribution means, and a gas supply means, the gas distribution means being operatively connected to the gas supply means to receive gas therefrom and being operatively positioned relative to the melt guide means to direct gas to a metal melt exiting downwardly from the orifice thereby atomizing the metal melt, the gas distribution means comprising:

means, operatively disposed about the melt guide tube orifice, for directing atomizing gas into an atomization zone for atomizing melt flowing from the melt guide tube, the directing means including a gas plenum for distributing the atomizing gas around the melt guide tube, a gas orifice operatively positioned relative to the atomization zone and a gas shield having a lower end in contact with the melt guide tube and being operatively located between the melt guide tube and the gas orifice for shielding the atomizing gas from heat orginating in the melt flowing through the melt guide tube, the gas shield having at least two parallel annular grooves, operatively positioned in a surface of the gas shield most proximate the melt guide tube and above the lower end, for reducing the amount of heat conducted from the melt flowing through the guide tube to the gas distribution means wherein freeze-off in the melt guide tube is prevented.

2. A close coupled gas atomization apparatus for the atomization of metals having melting temperatures above 1000° C., the apparatus comprising:

means for supplying melt to be atomized at a superheat of at most 50° C.;

a melt guide tube having a lower end, operatively connected to the melt supply means, for delivering the melt to an atomization zone, the lower end of the melt guide tube being inwardly tapered to a melt guide tube orifice;

gas supply means, operatively positioned relative to the melt guide tube orifice, for supplying atomizing gas at a temperature below that of the melt, into the atomization zone so that the melt flowing thereinto from the melt guide tube is atomized, the gas supply means including at least one gas inlet, a gas manifold for distributing gas around the melt guide tube, at least one gas orifice and at least one gas shield for guiding gas from the manifold to the at least one orifice, the at least one gas shield having an inside surface operatively positioned relative to the melt guide tube for guiding gas in the manifold to the orifice, the gas shield being positioned proximate the lower end of the melt guide tube and having a lower end at least partially in contact therewith such that heat from the melt guide tube is transferred from the melt guide tube to the gas shield; and at least two grooves formed in an outside surface of the gas shield for reducing the transfer of conductive heat from the higher temperature melt to the lower temperature gas.

3. The apparatus of claim 2, wherein the at least two grooves are parallel.

4. A close coupled gas atomization apparatus for atomization of metals having melting temperatures above 1000° C. wherein the apparatus comprises a melt guide means, including a melt guide tube having an orifice, a gas distribution means, and a gas supply means, the gas distribution means being operatively connected to the gas supply means to receive gas therefrom and being operatively positioned relative to the melt guide means to direct gas to a metal melt exiting the orifice thereby atomizing the metal melt, the gas distribution section comprising:

means, operatively disposed about the melt guide tube orifice, for directing the atomizing gas into an atomization zone for atomizing melt flowing downwardly from the melt guide tube, the directing means including a gas plenum for distributing the atomizing gas around the melt guide tube, a gas orifice operatively positioned relative to the atomization zone and a gas shield having a lower end in contact with the melt guide tube and being operatively located between the melt guide tube and the gas orifice for shielding the atomizing gas from heat originating in the melt flowing through the melt guide tube, the gas shield having at least two grooves in a surface thereof adjacent the melt guide tube and above the lower end for reducing the amount of heat conducted from the melt guide tube to the gas distribution means wherein freeze-off in the melt guide tube is prevented.

5. A close coupled gas atomization apparatus for the atomization of metals having melting temperatures above 1000° C., the apparatus comprising:

means for supplying melt to be atomized at a superheat of at most 50° C.;

a melt guide tube having a lower end, operatively connected to the melt supply means, for delivering the melt to an atomization zone, the lower end of the melt guide tube being inwardly tapered to a melt guide tube orifice;

gas supply means, operatively positioned relative to the melt guide tube orifice, for supplying atomizing gas at a temperature below that of the melt, into the atomization zone so that the melt flowing thereinto from the melt guide tube is atomized, the gas supply means including at least one gas inlet, a gas manifold for distributing gas around the melt guide tube, at least one gas orifice and at least one gas shield for guiding gas from the manifold to the at least one orifice, the at least one gas shield having an inside surface operatively positioned relative to the melt guide tube for guiding gas in the manifold to the orifice, the gas shield being positioned proximate the lower end of the melt guide tube and having a lower end at least partially in contact therewith such that heat from the melt guide tube is conducted from the melt guide tube to the gas shield; and a series of at least three grooves, formed in an outside surface of the gas shield reducing the transfer of conductive heat from the higher temperature melt to the lower temperature gas.

* * * * *